US007124992B1

(12) United States Patent
Colledge

(10) Patent No.: US 7,124,992 B1
(45) Date of Patent: Oct. 24, 2006

(54) TOOL SUPPORT UNIT

(76) Inventor: Leonard D. Colledge, 2595 Ida Rd., Windsor (CA)

( * ) Notice: Subject to any disclaimer, the term of this patent is extended or adjusted under 35 U.S.C. 154(b) by 123 days.

(21) Appl. No.: 10/986,232

(22) Filed: Nov. 12, 2004

(51) Int. Cl.
*A47B 91/00* (2006.01)
*A47G 29/00* (2006.01)
*B65D 19/00* (2006.01)

(52) U.S. Cl. ..... 248/346.07; 248/678; 248/646; 248/637; 108/44; 108/152

(58) Field of Classification Search ..... 248/678, 248/670, 346.07, 346.01, 646; 108/44, 152
See application file for complete search history.

(56) References Cited

U.S. PATENT DOCUMENTS

| | | | | | |
|---|---|---|---|---|---|
| 746,972 | A | | 12/1903 | Marsh | |
| 2,558,323 | A | | 6/1951 | Strun | |
| 2,739,624 | A | * | 3/1956 | Haddock | 83/471 |
| 2,914,191 | A | | 11/1959 | Bowden et al. | |
| 3,630,314 | A | * | 12/1971 | Bamburg et al. | 182/116 |
| 3,730,198 | A | * | 5/1973 | Johnston et al. | 135/69 |
| 3,741,131 | A | | 6/1973 | Leadbetter | |
| 4,111,409 | A | * | 9/1978 | Smith | 269/304 |
| 4,183,689 | A | * | 1/1980 | Wirges et al. | 403/31 |
| 4,310,207 | A | | 1/1982 | Adams, Jr. | |
| D278,294 | S | | 4/1985 | Dau | |
| 4,519,318 | A | | 5/1985 | Weldon-Ming | |
| 4,592,531 | A | * | 6/1986 | Schihl | 248/646 |
| D286,538 | S | * | 11/1986 | Duwell et al. | D15/141 |
| 4,757,849 | A | | 7/1988 | Morris | |
| 4,804,162 | A | * | 2/1989 | Rice | 248/671 |
| 4,919,384 | A | * | 4/1990 | Grimberg | 248/646 |
| 4,995,288 | A | * | 2/1991 | DellaPolla | 83/574 |
| 5,025,820 | A | * | 6/1991 | Gamper | 135/69 |
| 5,069,309 | A | * | 12/1991 | Swiderski et al. | 182/119 |
| 5,120,013 | A | * | 6/1992 | Sweeney | 248/238 |
| 5,308,037 | A | * | 5/1994 | Gonzalez | 248/670 |
| 5,394,781 | A | * | 3/1995 | Tsubai | 83/449 |
| 5,407,171 | A | * | 4/1995 | Gonzalez | 248/670 |
| 5,497,816 | A | * | 3/1996 | Darland | 144/287 |
| 5,787,782 | A | * | 8/1998 | Downard et al. | 83/574 |
| 5,810,373 | A | * | 9/1998 | Miranda | 280/47.2 |
| 5,875,828 | A | * | 3/1999 | Quiram et al. | 144/329 |
| 5,884,681 | A | * | 3/1999 | Nickles | 144/329 |
| 6,164,607 | A | * | 12/2000 | Hawkes | 248/97 |
| 6,443,260 | B1 | * | 9/2002 | Katz et al. | 182/129 |
| 6,668,696 | B1 | | 12/2003 | Krohmer et al. | |
| 6,695,266 | B1 | * | 2/2004 | Tsai | 248/125.8 |

* cited by examiner

*Primary Examiner*—Carl Friedman
*Assistant Examiner*—Michael McDuffie
(74) *Attorney, Agent, or Firm*—Donald R. Schoonover

(57) ABSTRACT

A tool support unit includes a first portion that is attached to a tool, such as a power saw or the like, and a second portion that is attached to a support, such as a table or the like. A telescoping connection between the two portions of tool support unit permits the first portion to be attached to and detached from the second portion.

3 Claims, 2 Drawing Sheets

12
60
10

V

T
SA

T
S
B

T

TOOL SUPPORT UNIT

BACKGROUND OF THE INVENTION

1. Field of the Invention

The present invention relates to the general art of support surfaces, and to the particular field of work surfaces.

2. Description of the Related Art

Most workmen have a plurality of tools that are used for various jobs. These tools range from simple hand tools to heavy tools that must be supported on a table, such as a power saw, drills, and the like. Often, a job requires the use of several of these heavy tools. In such cases, the workman must move from station to station to complete a job if the job is being done in a shop or factory. This is inconvenient and time consuming, especially if several people are working in a common shop in which case, the worker may have to wait for a previous worker to complete his or her work before completing his or her task, or the shop must have duplicates of the same tool which can be expensive especially for a small shop.

While the above situation is somewhat inconvenient, it is tolerable. However, the multiple tool problem is quite difficult if the worker must carry tools to a work site. Thus, if a worker travels to a job site, and must carry his or her tools in a vehicle, and then must use various power tools at the work site, he or she must place one tool on a tool support, use the tool, then remove the tool from the tool support and replace that tool with another tool. This is very time consuming and wasteful of effort.

Therefore, there is a need for a tool support system that is easy and efficient to use whereby tools can be quickly and efficiently moved onto and off of the support.

Still further, no power tool should be used without ensuring that the tool is securely anchored in place. However, if a worker must change tools, the possibility of improperly securing the tool increases.

Therefore, there is a need for a tool support system that is easy and efficient to use whereby tools can be quickly and efficiently moved onto and off of the support and still be securely anchored in place.

If a power tool is not stored in place on a support, there may be a possibility that the tool may sustain some sort of damage during storage. This may occur in particular with saws and the like.

Therefore, there is a need for a tool support system that is easy and efficient to use whereby tools can be quickly and efficiently moved onto and off of the support and the tools can be protected while in storage.

A further problem with tools such as sanders, saws, drill presses, and the like, is that such tools take up work space on a workbench when the tool is not being used. Most workmen like as much free work space as possible.

Therefore, there is a need for a means for supporting a tool in a manner that is out of the way when the tool is not in use, but is readily and quickly located for use when desired.

PRINCIPAL OBJECTS OF THE INVENTION

It is a main object of the present invention to provide a tool support system that is easy and efficient to use whereby tools can be quickly and efficiently moved onto and off of the support.

It is another object of the present invention to provide a tool support system that is easy and efficient to use whereby tools can be quickly and efficiently moved onto and off of the support and still be securely anchored in place.

It is another object of the present invention to provide a tool support system that is easy and efficient to use whereby tools can be quickly and efficiently moved onto and off of the support and the tools can be protected while in storage.

It is another object of the present invention to provide a means for supporting a tool in a manner that is out of the way when the tool is not in use, but is readily and quickly located for use when desired.

SUMMARY OF THE INVENTION

These, and other, objects are achieved by a tool support unit that includes a first portion that is attached to a tool, such as a power saw or the like, and a second portion that is attached to a support, such as a table or the like. A telescoping connection between the two portions of tool support unit permits the first portion to be attached to and detached from the second portion whereby the first portion, with a tool mounted thereon, can be mounted on a support, such as a table or the like, via the second portion of the unit.

Using the tool support unit embodying the present invention will permit a tool to be securely anchored to a base at all times, with the base being moved to mount and dismount the tool as needed. The tool will be easily and quickly moved and will be securely mounted at all times. With the support unit of the present invention, one tool can be moved from one work area to another whereby the same tool can be shared by several workers. This will save money as duplicates of the same tool are not needed. Furthermore, the tool can be protected by the portion of the tool support unit attached thereto and can be stored out of the way when not in use to free work space for a worker.

BRIEF DESCRIPTION OF THE DRAWING FIGURES

DETAILED DESCRIPTION OF THE PREFERRED EMBODIMENT

Figure 1:
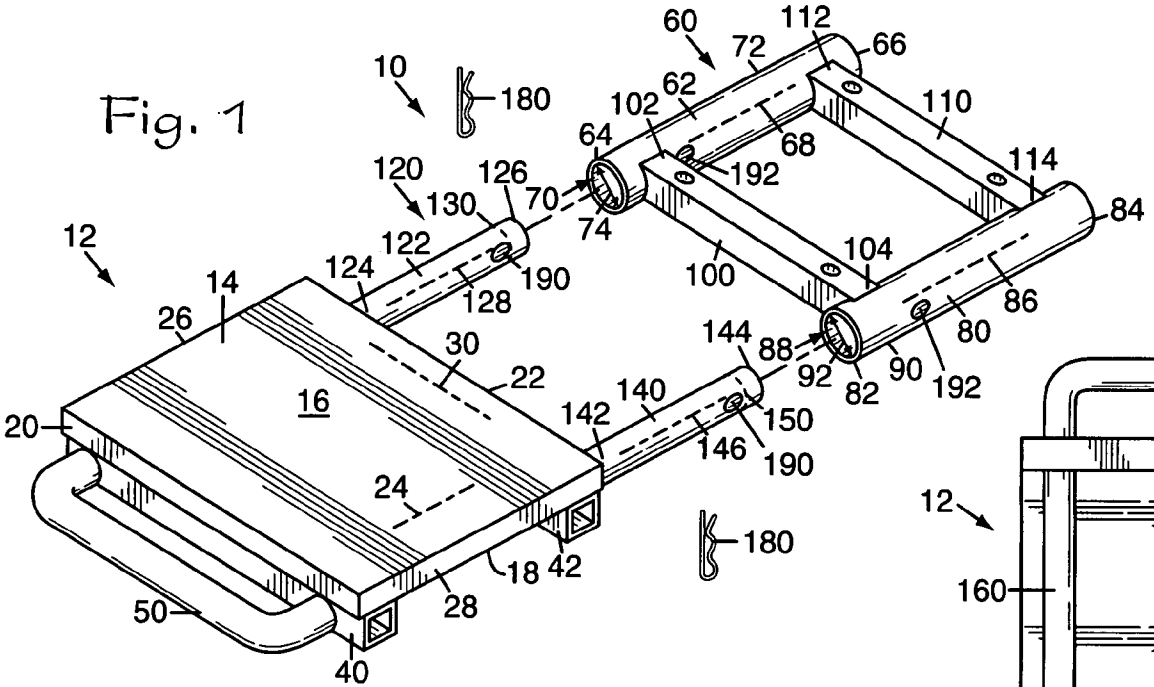
FIG. 1 is a perspective view of a portable work table embodying the present invention.
Figure 2:
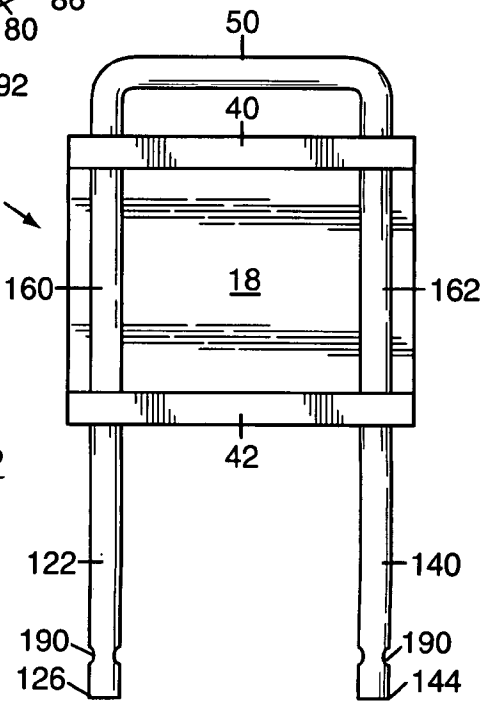
FIG. 2 is a bottom view of the portable work table embodying the present invention.

Other objects, features and advantages of the invention will become apparent from a consideration of the following detailed description and the accompanying drawings.

Referring to the Figures, it can be understood that the present invention is embodied in a tool support unit 10 which achieves the above-stated objectives.

Tool support unit 10 comprises a first portion 12 which includes a base 14 on which a tool, such as a saw, a drill press, or the like, is mounted when in use. Base 14 includes a first surface 16, which is a top surface when base 14 is in use, and a second surface 18, which is a bottom surface when base 14 is in use. Base 14 further includes a first end edge 20, a second end edge 22, and a longitudinal axis 24 which extends between first end edge 20 and second end edge 22. Base 14 further includes a first side edge 26, a second side edge 28, and a transverse axis 30 which extends between first side edge 26 and second side edge 28.

A first cross beam 40 is fixedly mounted on second surface 18 and extends in the direction of transverse axis 30, and a second cross beam 42 is also fixedly mounted on second surface 18 at a location spaced apart from first cross beam 40 along longitudinal axis 24. Second cross beam 42 extends in the direction of the transverse axis 30 parallel to and co-planar with first cross beam 40.

A handle 50 is fixedly mounted on first cross beam 40. Handle 50 is used to carry first portion 12 as will be understood from the teaching of this disclosure.

A second portion 60 is fixedly mounted on a support, such as a table, a workbench, a truck tailgate, or the like, when in use. Second portion 60 includes a first hollow tube 62 which has a first end 64, a second end 66, and a longitudinal axis 68 which extends between first end 64 and second end 66. A bore 70 is defined in hollow tube 62 and extends from first end 64 toward second end 66. Bore 70 can be a blind-ended bore if suitable. An outer surface 72 is defined on first hollow tube 62. Bore 70 has an inner diameter 74.

A second hollow tube 80 has a first end 82, a second end 84, and a longitudinal axis 86 which extends between first end 82 and second end 84. A bore 88 is defined in second hollow tube 80 and extends from first end 82 toward second end 84. Bore 88 can be a blind-ended bore if suitable. Second hollow tube 80 has an outer surface 90 defined thereon and is spaced apart from first hollow tube 62 in the direction of transverse axis 30 of base 14. Bore 88 has an inner diameter 92 and is co-planar with first hollow tube 62.

A first cross beam support 100 has a first end 102 fixedly attached to outer surface 72 of first hollow tube 62 adjacent to first end 64 of the first hollow tube 62 and a second end 104 fixedly attached to outer surface 90 of second hollow tube 80 adjacent to first end 82 of the second hollow tube 80.

A second cross beam support 110 has a first end 112 fixedly attached to outer surface 72 of first hollow tube 62 adjacent to second end 66 of the first hollow tube 62 and a second end 114 fixedly attached to outer surface 90 of second hollow tube 80 adjacent to second end 84 of the second hollow tube 80. Second cross beam support 110 is spaced apart from first cross beam support 100 in the direction of longitudinal axis 24 of base 14 of first portion 12. Second cross beam support 110 is co-planar with first cross beam support 100.

A connection unit 120 releasably connects first portion 12 to second portion 60 when in use. Connection unit 120 includes a first arm 122 which has a proximal end 124 fixedly mounted on second cross beam 42 adjacent to first side edge 26 of base 14, a distal end 126 spaced apart from proximal end 124 in the direction of longitudinal axis 24 of base 14. First arm 122 has a longitudinal axis 128 which extends between proximal end 124 and distal end 126 and an outer dimension 130 that is smaller than inner diameter 74 of first hollow tube 62 so first arm 122 can be telescopingly received in bore 70 of first hollow tube 62 when connection unit 120 is in use. Longitudinal axis 128 of first arm 122 is co-linear with longitudinal axis 68 of first hollow tube 62 when connection unit 120 is in use. First arm 122 is slidably accommodated in bore 70 of first hollow tube 62 when connection unit 120 is in use connecting first portion 12 to second portion 60.

A second arm 140 has a proximal end 142 fixedly mounted on second cross beam 42 of first portion 12 adjacent to second side edge 28 of base 14, a distal end 144 spaced apart from proximal end 142 in the direction of longitudinal axis 24 of base 14. Second arm 140 is spaced apart from first arm 122 in the direction of transverse axis 30 of base 14 and is co-planar with first arm 122. Second arm 140 has a longitudinal axis 146 which extends between proximal end 142 and distal end 144 and an outer dimension 150 that is smaller than inner diameter 92 of second hollow tube 80. Longitudinal axis 146 of second arm 140 is co-linear with longitudinal axis 86 of second hollow tube 80 when connection unit 120 is in use. Second arm 140 is slidably accommodated in bore 88 of the second hollow tube 80 when connection unit 120 is in use.

Further support for base 14 can be provided by support braces 160 and 162 if desired. Braces 160 and 162 extend in the direction of longitudinal axis 24 of base 14 and are spaced apart from each other in the direction of transverse axis 30 of base 14. Braces 160 and 162 are located to be co-linear with arms 122 and 140 respectively. If suitable, braces 160 and 162 can be continuations of arms 122 and 140 respectively so that the braces 160, 162 and the arms 122, 140 are one-piece with each other and extend through second cross brace 42. Braces 160 and 162 can be fixedly attached to second surface 18 of base 14 to add further support.

If suitable, locking elements, such as a locking pin 180, or the like, can be used to lock the hollow tubes 62 and 80 to arms 122 and 140 respectively. The locking pins can be accommodated in holes 190 and 192 defined in the cross beams 40 and 42 respectively with holes being defined in the arms 122 and 140 to be aligned with the holes defined in the cross beams as will be understood by those skilled in the art based on the teaching of this disclosure.

Figures 3A, 3B, 4A, 4B, 4C:
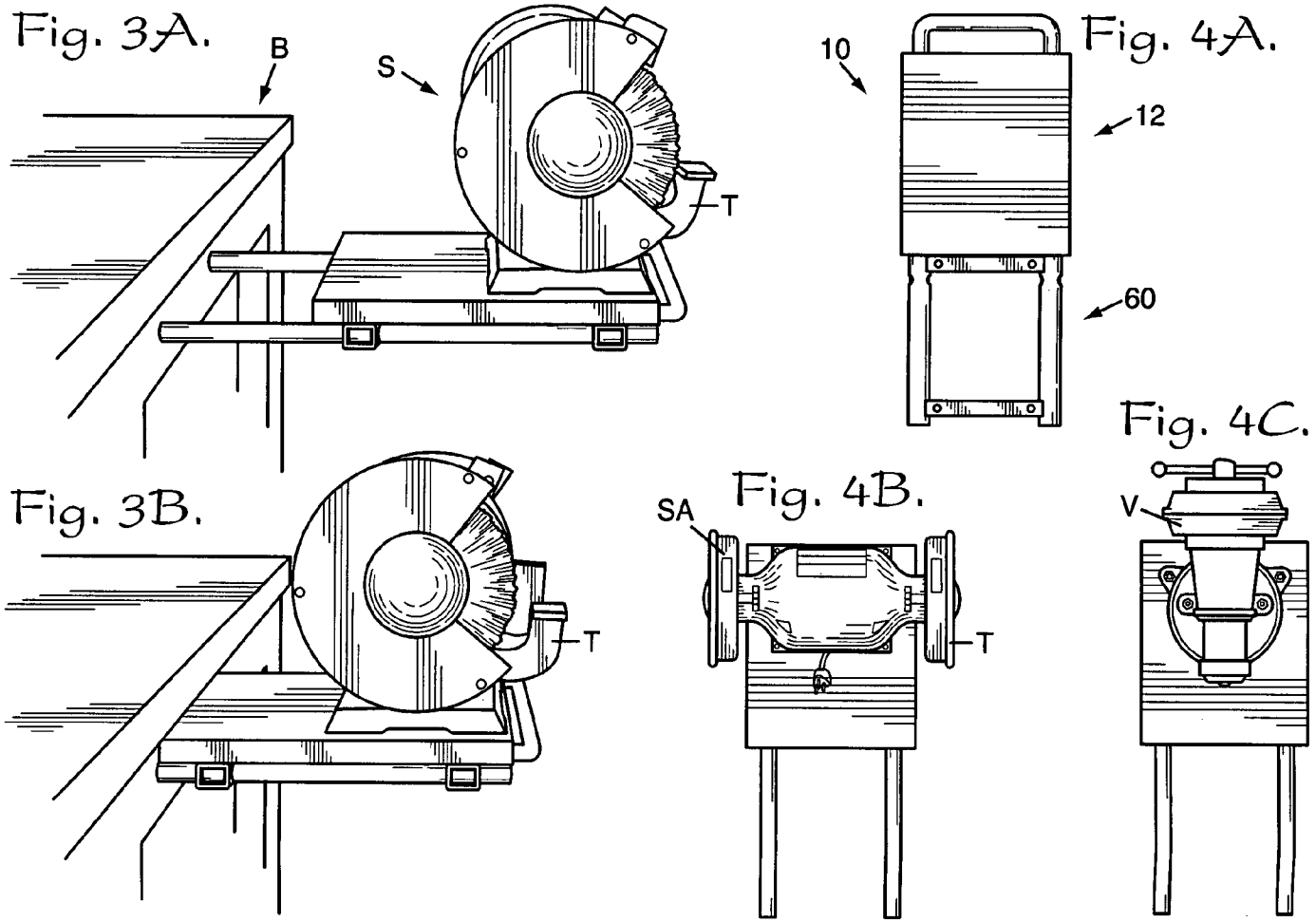
FIG. 3A shows the portable work table of the present invention supporting a tool and in an initial position.
FIG. 3B shows the portable work table in FIG. 3A in a use position.
FIG. 4A is an elevational view of the portable work table in a condition where a tool supporting portion is assembled with a supporting element engaging portion.
FIG. 4B shows one form of a tool mounted on the portable work table of the present invention.
FIG. 4C shows one form of a tool mounted on the portable work table of the present invention.

Use of unit 10 can be understood from the foregoing and from FIGS. 3A–4C. A tool T, such as a saw S is fixed to base 14, and arms 122 and 140 are slidably placed in the bores 70, 88 of hollow arms 62 and 80 respectively as indicated in FIG. 3A. Second portion 60 is firmly anchored on a support element, such as a work bench B, a trailer, a tailgate, a truck bumper, or the like. First portion 12 is then forced toward the support element and arms 122 and 140 are forced into the bores 70, 88 of hollow tubes 62 and 80 respectively until the first portion 12 with the tool thereon is securely held on the second portion 60 with arms 122 and 140 fully accommodated in bores 70 and 88 of hollow arms 62 and 80 respectively as shown in FIG. 3B. The first portion 12 can be removed from the second portion 60 by reversing the above-described steps.

An assembled unit 10 is shown in FIG. 4A and a unit having a sander or a grinder SA thereon is shown in FIG. 4B while a unit having a vise V thereon is shown in FIG. 4C. Other tools such as sewing machines, miter saws and the like can also be mounted using unit 10. These Figures show the versatility of unit 10 to accommodate any form of tool, and are intended as examples and are not intended as limitations.

The first portion 12 can be hung on a wall using appropriate hooks and handle 50 if desired. In this manner, any tool that is mounted on unit 10 can be easily and safely stored, yet will be quickly and easily mounted on a workbench or other such support when needed.

It is understood that while certain forms of the present invention have been illustrated and described herein, it is not to be limited to the specific forms or arrangements of parts described and shown.

What is needed and desired to be covered by Letters Patent is as follows:

1. A tool support unit comprising:

(a) a first portion which includes (1) a base on which a tool is mounted when in use, the base including (A) a first surface which is a top surface when the base is in use, (B) a second surface which is a bottom surface when the base is in use, (C) a first end edge, (D) a second end edge, (E) a longitudinal axis which extends between the first end edge of the base of said first portion and the second end edge of the base of said first portion, (F) a first side edge, (G) a second side edge, (H) a transverse axis which extends between the first side edge of the base of said first portion and the second side edge of the base of said first portion, (I) a first cross beam fixedly mounted on the second surface and extending in the direction of the transverse axis, and (J) a second cross beam fixedly mounted on the second surface at a location spaced apart from the first cross beam along the longitudinal axis, the second cross beam extending in the direction of the transverse axis, and (2) a handle fixedly mounted on the first cross beam;

(b) a second portion which is fixedly mounted on a support when in use and which includes (1) a first hollow tube having a first end, a second end, a longitudinal axis which extends between the first end of the first hollow tube and the second end of the first hollow tube, a bore which extends from the first end of the first hollow tube toward the second end of the first hollow tube, and an outer surface of the first hollow tube, the bore of the first hollow tube having an inner diameter, (2) a second hollow tube having a first end, a second end, a longitudinal axis which extends between the first end of the second hollow tube and the second end of the second hollow tube, a bore which extends from the first end of the second hollow tube toward the second end of the second hollow tube, and an outer surface of the second hollow tube, the second hollow tube being spaced apart from the first hollow tube in the direction of the transverse axis of the base of said first portion, the bore of the second hollow tube having an inner diameter, the second hollow tube being co-planar with the first hollow tube, (3) a first cross beam support having a first end fixedly attached to the outer surface of the first hollow tube adjacent to the first end of the first hollow tube and a second end fixedly attached to the outer surface of the second hollow tube adjacent to the first end of the second hollow tube, and (4) a second cross beam support having a first end fixedly attached to the outer surface of the first hollow tube adjacent to the second end of the first hollow tube and a second end fixedly attached to the outer surface of the second hollow tube adjacent to the second end of the second hollow tube, the second cross beam support being spaced apart from the first cross beam support in the direction of the longitudinal axis of the base of said first portion, the second cross beam support being co-planar with the first cross beam support; and (c) a connection unit which releasably connects said first portion to said second portion when in use and which includes (1) a first arm which has a proximal end fixedly mounted on the second cross beam of said first portion adjacent to the first side edge of the base of said first portion, a distal end spaced apart from the proximal end of the first arm in the direction of the longitudinal axis of the base of said first portion, the first arm having a longitudinal axis which extends between the proximal end of the first arm and the distal end of the first arm, and an outer dimension that is smaller than the inner diameter of the first hollow tube, the longitudinal axis of the first arm being co-linear with the longitudinal axis of the first hollow tube when said connection unit is in use, and the first arm being slidably accommodated in the bore of the first hollow tube when said connection unit is in use, and (2) a second arm which has a proximal end fixedly mounted on the second cross beam of said first portion adjacent to the second side edge of the base of said first portion, a distal end spaced apart from the proximal end of the second arm in the direction of the longitudinal axis of the base of said first portion, the second arm being spaced apart from the first arm in the direction of the transverse axis of the base of said first portion and being co-planar with the first arm, the second arm having a longitudinal axis which extends between the proximal end of the second arm and the distal end of the second arm, and an outer dimension that is smaller than the inner diameter of the second hollow tube, the longitudinal axis of the second arm being co-linear with the longitudinal axis of the second hollow tube when said connection unit is in use, and the second arm being slidably accommodated in the bore of the second hollow tube when said connection unit is in use.

2. The tool support as described in claim 1 further including a lock unit locking the first hollow tube to the first arm when said connection unit is in use.

3. The tool support as described in claim 2 further including a second lock unit locking the second hollow tube to the second arm when said connection unit is in use.

* * * * *